US009464806B2

(12) United States Patent
Hensley

(10) Patent No.: US 9,464,806 B2
(45) Date of Patent: Oct. 11, 2016

(54) BOLT CLEANING AND FIRE STARTING SURVIVAL TOOL

(71) Applicant: Jashua Allen Hensley, Corona, CA (US)

(72) Inventor: Jashua Allen Hensley, Corona, CA (US)

( * ) Notice: Subject to any disclaimer, the term of this patent is extended or adjusted under 35 U.S.C. 154(b) by 0 days.

(21) Appl. No.: 14/615,285

(22) Filed: Feb. 5, 2015

(65) Prior Publication Data

US 2015/0308686 A1 Oct. 29, 2015

Related U.S. Application Data

(60) Provisional application No. 61/971,284, filed on Mar. 27, 2014.

(51) Int. Cl.

| | |
|---|---|
| ***F41A 15/00*** | (2006.01) |
| ***F23Q 1/06*** | (2006.01) |
| ***F41A 29/02*** | (2006.01) |

(52) U.S. Cl.
CPC *F23Q 1/06* (2013.01); *F41A 29/02* (2013.01)

(58) Field of Classification Search
USPC ..... 42/90, 106; 7/167, 158
See application file for complete search history.

(56) References Cited

U.S. PATENT DOCUMENTS

| | | | | |
|---|---|---|---|---|
| 4,672,745 | A * | 6/1987 | Wilkens | B25G 1/102 30/123 |
| 6,782,576 | B1 | 8/2004 | Valencic et al. | |
| 7,644,529 | B2 * | 1/2010 | Hopper | F41A 29/02 15/93.1 |
| 8,186,995 | B2 * | 5/2012 | Putrello, Jr. | F23Q 1/06 148/401 |
| 8,713,735 | B1 * | 5/2014 | Pelton | B26B 11/006 7/138 |
| 9,003,665 | B2 * | 4/2015 | Pelton | B25F 1/006 30/123 |
| 9,090,385 | B2 * | 7/2015 | Blagojevic | B65D 53/00 |

OTHER PUBLICATIONS

Botach.com Kley-Zio CRT Bolt Carrier Assembly.

* cited by examiner

*Primary Examiner* — J. Woodrow Eldred
(74) *Attorney, Agent, or Firm* — Kirk A. Buhler; Buhler & Associates

(57) ABSTRACT

Improvements in a multi-functional gun bolt cleaning and fire starting survival tool. The tool is specifically designed for owners and operators of semi-automatic and fully automatic firearms that utilize a rotating breech bolt (for example, the M-4 carbine, M16 and AR-15 type rifles). The tool has a steel tool designed to scrape carbon buildup off on critical surfaces so the firearm may function. The tool incorporates a flint rod for use with the steel tool, creating sparks for starting fires. The housing of the device keeps the other parts away from elements and acts as a handle for the flint rod when trying to start fires. The entire device is designed to fit within compartments found in common firearms accessories.

18 Claims, 3 Drawing Sheets

BOLT CLEANING AND FIRE STARTING SURVIVAL TOOL

CROSS REFERENCE TO RELATED APPLICATION

This application claims the benefit of Provisional Application Ser. No. 61/971,284 filed Mar. 27, 2014 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in a gun bolt cleaning and fire starting survival tool. More particularly, the present gun bolt cleaning and fire starting survival tool is a multi-function survival and rifle bolt cleaning tool that relates to outdoor, camping, hunting, sporting goods and military equipment, and is specifically directed for owners and users of semiautomatic and fully automatic firearms that utilize a rotating breech bolt.

2. Description of Related Art including information disclosed under 37 CFR 1.97 and 1.98

The operating system of these firearms routes high-pressure gas from the fired cartridge case directly into the bolt carrier to provide the necessary energy to operate the bolt once for every round fired. A problem that is unique to this "direct gas impingement" design arises with the accumulation of carbon from the gunpowder residue collecting inside the bolt carrier, inside the bolt carrier key, on the bolt lugs, and on the outer and inner aft or tail end of the bolt, in and around the bolt's gas sealing rings. If this carbon fouling is not removed regularly, the action of the bolt and bolt carrier can be slowed and eventually interrupted, thus causing the firearm to "jam" or fail to complete the process of extracting an empty round and loading a live one. In circumstances where the firearm is employed in a military or law enforcement application, these sudden stoppages can be life-threatening to the operator.

Current methods for cleaning carbon deposits from a bolt can best be described as "free-hand" in that a person takes a cleaning brush, pocket knife, modified brass cartridge case or the like and attempts to scrape away the carbon on the outer tail section of the bolt. These methods are imprecise, and they also risk scraping the gas sealing rings, which are situated immediately ahead of the tail section of the bolt where the carbon deposits build up. If the gas scaling rings are dislodged or damaged by a cleaning tool, the rifle operation will be disabled.

While many operators of these firearms have said accessories installed on their firearms with said compartments, few use said compartment for their intended uses. Most leave said compartment empty due to a lack of need for said batteries and lack of other options. It is in these common compartments of common firearms accessories that this current invention is designed to fit.

A number of patents and or publications have been made to address these issues. Exemplary examples of patents and or publication that try to address this/these problem(s) are identified and discussed below.

U.S. Pat. No. 6,782,576 issued on Aug. 31, 2004 to Michael Valencic et al discloses a Survival Tool. While the survival too provides a variety of tools, it does not include firearm cleaning surfaces and further does not fit within a firearm when not being used.

U.S. Pat. No. 7,644,529 issued on Jan. 12, 2010 to James Vester Hopper et al discloses a Rifle Bolt Cleaning Tool. The bolt cleaning tool does not offer any survival tool functions and further does not fit within a compartment on a firearm.

U.S. Pat. No. 8,1186,995 issued on May 29, 2012 to Andrew C. Putrello Jr discloses a Survival Tool Fire Starter with Mischmetal Flint Rod. This tool is essentially just a fire starting tool and offers minimal other survival tools and no gun cleaning surfaces.

What is needed is a combination gun cleaning, fire starting and sharpening survival tool that fits within a firearm. The gun bolt cleaning and fire starting survival tool disclosed in this document provides the solution.

BRIEF SUMMARY OF THE INVENTION

It is an object of the gun bolt cleaning and fire starting survival tool to clean a rifle bolt, bolt carrier and firing pin. The components included in the bolt carrier portion of a semi-automatic or fully automatic firearm are responsible for feeding live ammunition from the magazine, inserting it into the chamber, providing the firing pin strike that initiates the firing of the ammunition, and extracting and ejecting the spent round from the firing chamber.

It is another object of the gun bolt cleaning and fire starting survival tool to producing fire. Emergency fire starters are typically included as equipment for many civilian and military occupations, as well as for recreational outdoor use, due to fires impact on the outcome of a survival situation. In its simplest form, a steel strike plate member is struck against a flint member, e.g., a flint rod, to produce sparks. The sparks can be used to ignite a finely divided flammable material, which can then be used to light a fire on available flammable materials, e.g., fire wood. Most survival starters today focus solely on starting fires. The gun bolt cleaning and fire starting survival tool incorporates a fire starter with a bolt cleaning tool.

It is still another object of the gun bolt cleaning and fire starting survival tool to utilization of wasted space within the firearm. There are multitudes of M-4 carbine, M16 and AR-15 type rifles being produced each year. It has become commonplace for companies to make firearm accessories for said rifles. Some common accessories include enhanced vertical forward grips and enhanced butt stocks. These are just two common accessories that are commonly made with storage compartments. Said compartments are most commonly made to accept "AA" or "CR123" type batteries, but some compartments are made for other reasons.

It is another object of the gun bolt cleaning and fire starting survival tool to provide a means of cleaning a rifles bolt that can be readily accomplished in low light conditions, harsh operating environments, and by gloved hands, if necessary.

It is another object of the gun bolt cleaning and fire starting survival tool to provide a tool that accomplishes precise cleaning of the inner portion of the bolt carrier, the bolt carrier key, the bolt face, all of the edges on the inner and outer tail end of the bolt, the bolt lugs and the firing pin.

It is another object of the gun bolt cleaning and fire starting survival tool to provide a bolt cleaning tool that scrapes the tail end of the bolt and that does not come into contact with the gas sealing rings.

It is another object of the gun bolt cleaning and fire starting survival tool to provide a sharpening rod to sharpen cutting and scraping blades without the need to carry a separate sharpening rod or stone.

It is another object of the gun bolt cleaning and fire starting survival tool to provide a bolt cleaning tool that is portable, light and small so that it can be carried in the field without burdening the operator with extra weight or bulk.

It is another object of the gun bolt cleaning and fire starting survival tool to provide a survival tool for starting fires that is simple in design and usage, compact, reliable, and overcomes the drawbacks of conventional fire starters. A further object to provide a fire starter that can reliably ignite a fire under most outdoor conditions, and notably in a survival situation where the ability to start a fire is critical to survival.

It is still another object of the gun bolt cleaning and fire starting survival tool to provide a compartment within that is relatively safe from environmental contamination when not in use.

It is another object of the gun bolt cleaning and fire starting survival tool to be of particular size as to fit snugly into common compartments found in firearms accessories. This fit allows it to be readily available in a time of need, and stops it from moving around within said compartment causing unwanted noise.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1A:
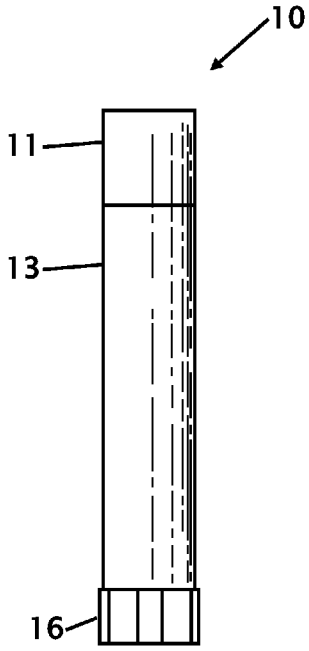
FIG. 1A shows a plan view of the enclosure for the gun bolt cleaning and fire starting survival tool.
Figure 1B:
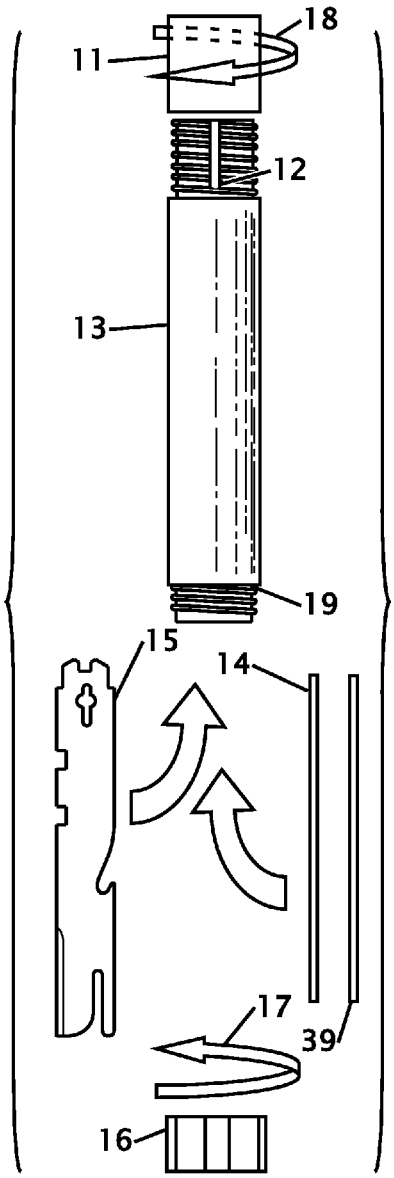
FIG. 1B shows an exploded view of the gun bolt cleaning and fire starting survival tool and the housing.
Figure 1C:
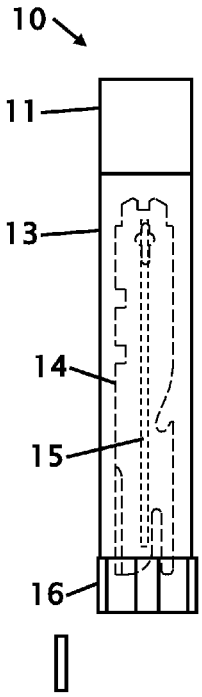
FIG. 1C shows a plan view of the housing with the gun bolt cleaning and fire starting survival tool inside the housing

FIG. 1A shows a plan view of the enclosure 10 for the gun bolt cleaning 15 and fire starting 14 and sharpening 39 survival tool, FIG. 1B shows an exploded view of the gun bolt cleaning 15 and fire starting 14 survival tool and the housing 10 and FIG. 1C shows a plan view of the housing with the gun bolt cleaning 15, fire starting 14 and sharpening 39 survival tool inside the housing 10 in a preferred embodiment. The final product may look different in appearance but will accomplish the same features. The figure shows how the tool is contained, taken apart, and reassembled for use as a fire starter. The end cap 16 is unscrewed from the housing 13. The flint rod 14 and the steel tool 15 are taken out. The end cap 16 is screwed 17 back on to the housing 13. A washer 19 seals the end cap 16 on the housing 13. The compression cap 11 is a screw on cap with a hole on top the exact diameter of the flint rod 14. The compression cap 11 is unscrewed 18, the flint rod 14 is placed in the seating notch 12, and the compression cap 11 is placed over the flint rod 14 and screwed back on to the threads of the seating notch 12 for a tight fit. The housing 13 is used as a handle for the flint rod 14. The appropriate surface on the steel tool 15 is then scraped against the flint rod 14 and sparks are created for starting fire. In FIG. 1 the steel tool is a single flat piece of metal or plastic.

Figure 2A:
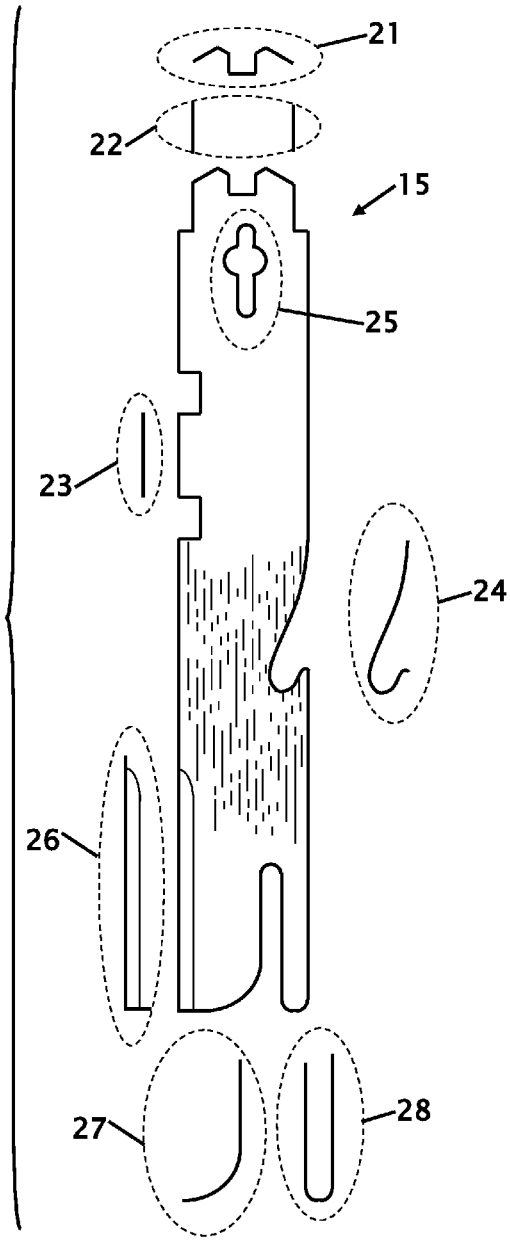
FIG. 2A shows a first preferred embodiment and an exploded perspective view of the preferred one piece example of the steel tool 15 from FIG. 1.
Figure 2B:
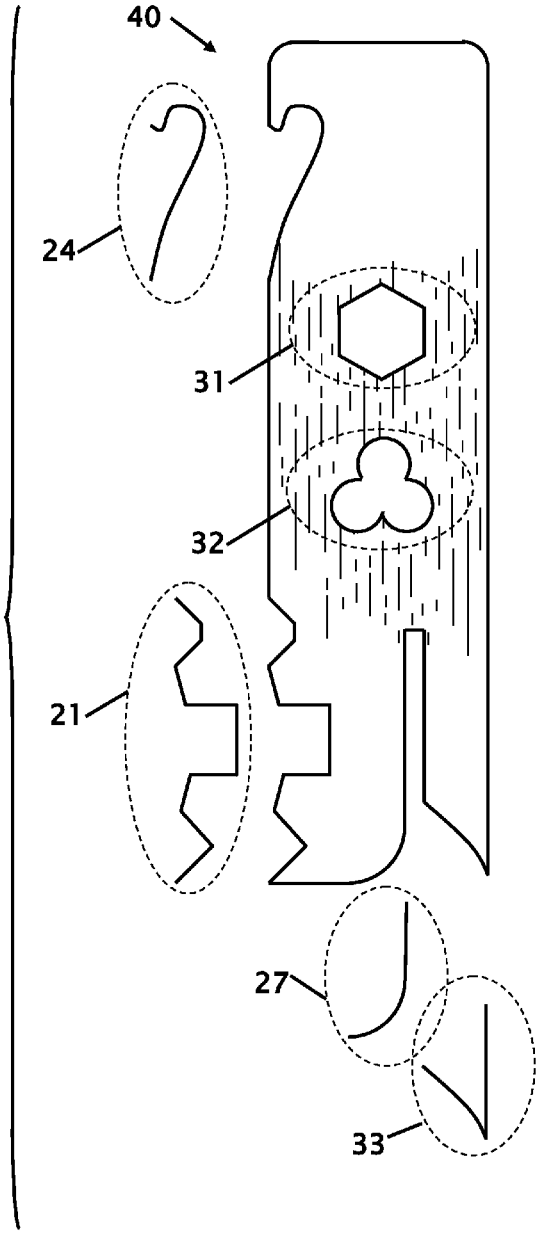
FIG. 2B shows a second preferred embodiment and an exploded perspective view of the preferred one piece example of the steel tool 40.

FIGS. 2A and 2B show exploded perspective views of two preferred one piece embodiments of the steel tool 15 from FIGS. 1 and 40.

FIGS. 2A and 2B are an exploded plan views of preferred one piece examples of the steel tool 15 from FIG. 1 and a second embodiment 40 is FIG. 2B. In these figures the steel tools 15*a* and 40 are shown with the surfaces separated from the steel tool 15 and 40. The multiple functions of this embodiment of the tool include:

21 a surface for cleaning bolt lugs.

22 a surface for cleaning bolt carrier inner walls.

23 a surface for cleaning the bolt face.

24 a surface for opening a glass bottle.

25 A cut-out for cleaning a firing pin and a space for a cleaning cloth.

26 a surface for scraping against a flint rod.

27 a surface for cleaning the outer walls of a bolt tail end.

28 a surface for cleaning the inner walls of the bolt tail and bolt carrier gas key inner walls.

31 a hex socket for gripping a nut or hex rod.

32 a socket for gripping a nut or hex rod.

33 a pointed scraper for clearing holes.

The "Steel Tool" 15 and 40 have many functions. Primarily it is a rifle bolt cleaning tool made of metal. In the preferred embodiments the steel tool 15 or 40 is made of one piece for simplicity and ease of use; however it may be made of multiple pieces connected together to form one. Some reasons for having multiple pieces include: adjustable and replaceable scraping surfaces for better cleaning and the ability for changing scraping surfaces after they wear out.

In a preferred embodiment the scraping surfaces include: one end designed to fit inside a bolt carrier group to clean within, one surface designed with "teeth" to scrape in and around the bolt's locking lugs, one surface has radiuses to match that of a rifle bolts outer back end, another surface has a radius for the cleaning of the bolts inner back end as well as the bolt carrier key, along one side is a straight edge used for scraping against a flint to produce sparks, along another side is a surface with grooves designed for allowing a scraping surface to clean the bolt face, a hole will be designed in the current gun bolt cleaning and fire starting survival tool to accommodate a firing pin and cloth cleaning patch, and an optional feature is a "hook" designed for use as a glass bottle opener. These figures show only two preferred examples and the final product may look different from the image on FIG. 2. It is further contemplated that a saw and or file can be incorporated into the steel tool 15 or 40 to provider further functions.

Figure 3:
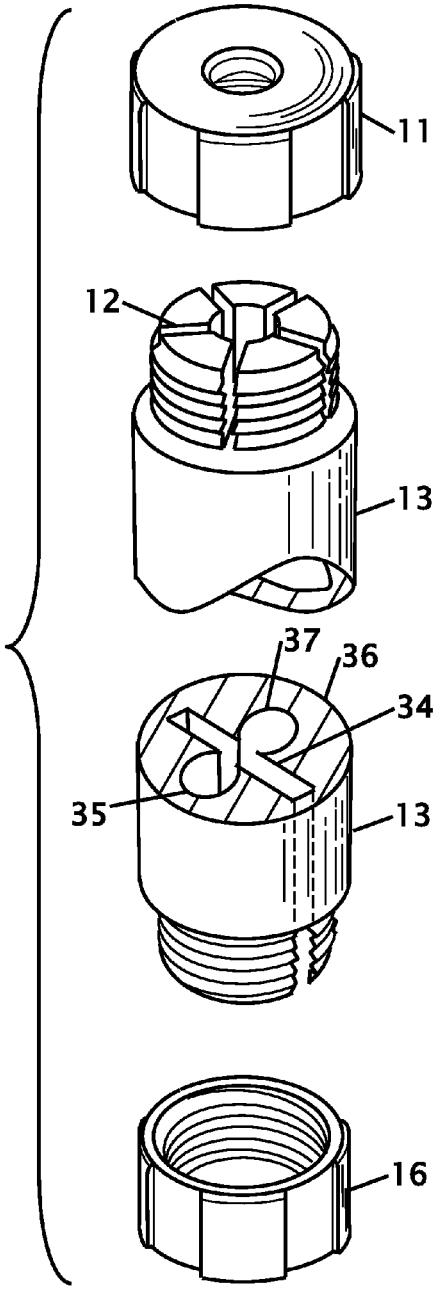
FIG. 3 shows a first preferred embodiment of the enclosure to house the gun bolt cleaning and fire starting survival tool.
Figure 4:
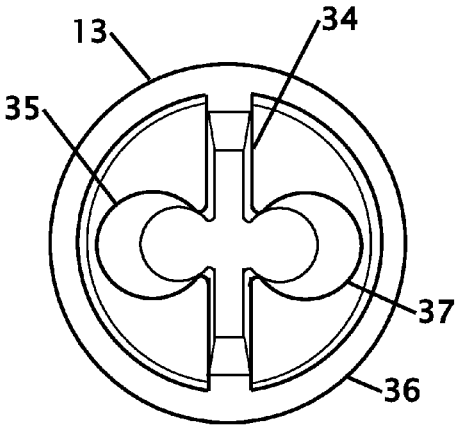
FIG. 4 shows an end view of the housing opening where the tools and starter is stored.

FIG. 3 shows a first preferred embodiment of the enclosure to house the gun bolt cleaning and fire starting survival tool with the compression cap 11, threads with a sealing notch 12 for the compression cap. The housing 13 is shown broken away to show the internal cross-section with compartments for the flint rod 35, the steel tool 34 and the sharpening rod 37. The end cap 16 is shown at the bottom of this view. FIG. 4 shows an end view of the housing opening where the flint rod 35 and the steel tool 34 tool is stored within the housing 13.

The "Housing" 13 has multiple functions as well. In a preferred embodiment, this piece of the present gun bolt cleaning 15, or 40, the fire starting 14 and sharpening rod 39 survival tool would be made of a plastic or polymer material, it has a tubular space within to encapsulate the flint rod 14, sharpening rod 39 and steel tool 15 or 40, the compartment is solid on one side and open on the other, the open end is sealed with a solid cap threaded on creating a water tight seal with a rubber washer between, the opposite side of the end cap has a seating notch designed so the flint will fit snugly into it, once seated the compression cap is fitted over the flint and screwed down tight creating a tight grip on the flint, the seating cap has a hole 35 the exact diameter of the flint 14 or sharpening rod 39 and compress the notches into the flint to hold it tight; this allows the housing to act as a handle for convenient use of the flint rod 14 or sharpening rod 39. Opening 36 can be used to store a rag or wadding for cleaning the barrel of the firearm or other surfaces.

Operation

When the present gun bolt cleaning and fire starting survival tool is not in use, the flint rod and steel tool are inside the housing. The end cap 16 and compression cap 11 are screwed on tight to create a water tight compartment. The gun bolt cleaning 15 or 40 and fire starting 14 survival tool is ready to fit in a compartment 13 within a common firearm accessory or placed in a user's bag or on his or her person.

When the present gun bolt cleaning 15 or 40, sharpening rod 39 and the fire starting 14 survival tool are ready for use as a fire starter 14 it is first taken out of its location. The end cap 16 is then unscrewed, the contents are taken out and the end cap 16 is screwed back on. Then the compression cap 11 is unscrewed, flint rod 14 or sharpener rod 39 is placed into the seating notch and the compression cap is placed over the end of the flint rod 14 or sharpener rod 39 and screwed on until the flint is firmly held in place. Finally the flint 14 scraping surface of the steel tool 15 is scrapped 26 along the flint and sparks are created.

When the present gun bolt cleaning 15 or 40 and fire starting 14 with a blade sharpening rod 39 survival tool is ready for use as a bolt cleaner, it is first taken out form its location. The end cap 16 is taken off, the steel tool 15 or 40 is taken out and the end cap 16 is screwed back on. The steel tool 15 or 40 is ready for cleaning the many common surfaces of the AR-15/M4/M16 rifle bolts, bolt carrier groups, firing pins, or opening bottle caps. In a multi piece design for the steel tool, some tuning or adjusting may need to be done before initial use.

The present gun bolt cleaning 15 or 40, fire starting 14, and sharpening rod 39 survival tool is a multi-function survival tool directed at owners and users of semi-automatic and fully automatic firearms that utilize a rotating breech bolt. The tool comprises of two basic components that fit within a third for storage.

In this embodiment of the gun bolt cleaning 15 or 40 and fire starting 14 survival tool the "Flint Rod" 14 is formed of a mischmetal material having a negative standard reduction potential and a composition, by weight, generally as follows: Cerium—one half Lanthanum—one quarter Magnesium—at least ten percent Other rare earth elements—up to five percent Iron—balance (usually about the same amount as the magnesium).

Thus, specific embodiments of a gun bolt cleaning and fire starting survival tool have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A gun bolt cleaning and fire starting survival tool comprising:

a one-piece metal survival tool;

a flint rod;

a blade sharpening rod configured to sharpen said one-piece survival tool;

a water tight housing with a threaded compression cap configured to hold said on-piece metal survival tool, said blade sharpening rod and said flint rod completely therein, and said water tight housing further has a feature to hold said flint rod at least partially outside of said housing thereby allowing access to at least a surface of said flint rod, said water tight housing is tubular in shape and is closed at a first end and is open at an opposing second end that is closed with a cap having a water-tight washer, said opposing second end has a notch to retain said flint rod in a perpendicular relationship between said watertight housing and said compression cap.

2. The gun bolt cleaning and fire starting survival tool according to claim 1 wherein said one-piece metal survival tool includes at least one of a group consisting of a surface to scrape clean inner walls of a bolt carrier, a surface to scrape clean inner walls of a bolt carrier key, a surface to scrape clean a bolt face, a surface to scrape clean bolt lugs, a surface to scrape clean a firing pin, a surface to scrape clean inner walls of a tail end of said bolt and a surface to scrape clean outer walls of said tail end of said bolt.

3. The gun bolt cleaning and fire starting survival tool according to claim 1 wherein said one-piece metal survival tool includes an area for scraping against said flint rod to produce sparks for making a fire.

4. The gun bolt cleaning and fire starting survival tool according to claim 1 wherein said one-piece metal survival tool includes a hook for opening caps on glass bottles.

5. The gun bolt cleaning and fire starting survival tool according to claim 1 wherein said water tight housing is made of plastic.

6. The gun bolt cleaning and fire starting survival tool according to claim 5 wherein said water tight plastic housing is formed from injection molding.

7. The gun bolt cleaning and fire starting survival tool according to claim 1 wherein said opposing second end has a compression cap with a hole that corresponds to a diameter of said flint rod.

8. The gun bolt cleaning and fire starting survival tool according to claim 7 wherein said threaded compression cap screws over said flint rod to hold said flint rod securely in said water tight housing.

9. The gun bolt cleaning and fire starting survival tool according to claim 1 wherein a portion of said one-piece metal survival tool has a hole configured with a firing pin cleaning surface.

10. The gun bolt cleaning and fire starting survival tool according to claim 9 wherein said hole further creates a place for a cleaning rag to be inserted.

11. The gun bolt cleaning and fire starting survival tool according to claim 10 wherein said cleaning rag cleans a bolt carrier group inner walls.

12. The gun bolt cleaning and fire starting survival tool according to claim 1 wherein said one-piece metal survival tool is formed from multiple pieces of material.

13. The gun bolt cleaning and fire starting survival tool according to claim 1 wherein said housing further includes a compartment for storage of a cleaning rag or wadding.

14. The gun bolt cleaning and fire starting survival tool according to claim 1 wherein said housing is sized as two AA batteries or two CR123 batteries placed axially with abutting axial ends.

15. The gun bolt cleaning and fire starting survival tool according to claim 1 wherein said housing grips said one-piece metal survival tool and said flint rod such that neither said one-piece metal survival tool and said flint rod are prevented from free movement with said housing.

16. The gun bolt cleaning and fire starting survival tool according to claim 1 wherein said housing is storable within a compartment within a firearm accessory.

17. A gun bolt cleaning and fire starting survival tool comprising:

a one-piece metal survival tool;

a flint rod;

a blade sharpening rod configured to sharpen said one-piece survival tool;

a water tight housing with a threaded compression cap configured to hold said on-piece metal survival tool, said blade sharpening rod and said flint rod completely therein;

said water tight housing further has a feature to hold said flint rod at least partially outside of said housing thereby allowing access to at least a surface of said flint rod, and said housing has at least one seating notch whereby said flint rod is configured to engage in said seating notch and be compressed in said seating notch with said threaded compression cap whereby said housing is configured as a handle for said flint rod.

18. A gun bolt cleaning and fire starting survival tool comprising:

a one-piece metal survival tool;

a flint rod;

a blade sharpening rod configured to sharpen said one-piece survival tool;

a water tight housing with a threaded compression cap configured to hold said on-piece metal survival tool, said blade sharpening rod and said flint rod completely therein;

said water tight housing further has a feature to hold said flint rod at least partially outside of said housing thereby allowing access to at least a surface of said flint rod, and said housing has at least one seating notch whereby said flint sharpening rod is configured to engage in said seating notch and be compressed in said seating notch with said threaded compression cap whereby said housing is configured as a handle for said sharpening rod.

* * * * *